United States Patent [19]

Driessen et al.

[11] 4,253,037

[45] Feb. 24, 1981

[54] HIGH-PRESSURE SODIUM-VAPOR DISCHARGE LAMP

[75] Inventors: Antonius J. G. C. Driessen; Cornelis A. J. Jacobs, both of Eindhoven, Netherlands

[73] Assignee: U.S. Philips Corporation, New York, N.Y.

[21] Appl. No.: 6,392

[22] Filed: Jan. 25, 1979

[30] Foreign Application Priority Data

Feb. 22, 1978 [NL] Netherlands ..... 7801972

[51] Int. Cl.[3] ..... H01J 61/16; H01J 61/22; H01J 61/30

[52] U.S. Cl. ..... 313/25; 313/113; 313/184; 313/214; 313/225; 313/229

[58] Field of Search ..... 313/225, 113, 229, 184, 313/214, 25

[56] References Cited

U.S. PATENT DOCUMENTS

| | | | |
|---|---|---|---|
| 2,830,210 | 4/1958 | Jenne, Jr. et al. | 313/25 |
| 3,248,590 | 4/1966 | Schmidt | 313/225 X |
| 3,384,798 | 5/1968 | Schmidt | 313/225 |
| 3,898,504 | 8/1975 | Akutsu et al. | 313/184 X |
| 3,906,272 | 9/1975 | Collins et al. | 313/214 |
| 3,931,536 | 1/1976 | Fohl et al. | 313/113 |
| 3,974,410 | 8/1976 | Collins et al. | 313/229 X |
| 4,052,636 | 10/1977 | Strok | 313/214 X |
| 4,109,175 | 8/1978 | Watarai et al. | 313/113 X |
| 4,146,813 | 3/1979 | Van Vliet | 313/225 X |

*Primary Examiner*—Palmer C. Demeo
*Attorney, Agent, or Firm*—Robert S. Smith

[57] ABSTRACT

The invention relates to a high-pressure sodium-vapor discharge lamp having substantially the same color temperature as an incandescent lamp. The invention provides a high-pressure sodium-vapor discharge lamp having a low re-ignition voltage.

This is achieved by including xenon and mercury in the discharge tube such that (i) the weight of mercury is between 50% and 90% of the combined weight of the mercury and sodium, (ii) the pressure of the xenon at room temperature is between 100 and 1000 torr, and (iii) the sodium vapor pressure is between 300 and 800 torr in the operating condition of the lamp. The power consumed by such a lamp is typically one-fifth of that consumed by an incandescent lamp having the same light output.

5 Claims, 4 Drawing Figures

HIGH-PRESSURE SODIUM-VAPOR DISCHARGE LAMP

The invention relates to a high-pressure sodium-vapor discharge lamp comprising a discharge tube which contains an excess of sodium and mercury and also contains xenon, whereby in the operating condition of the lamp the sodium-vapor pressure in the discharge tube exceeds 300 torr and the mercury functions as a buffer gas.

A high-pressure sodium-vapor discharge lamp of the above defined type is, for example, disclosed in U.S. Pat. No. 3,716,743. With this prior art lamp a color temperature is obtained which is considerably higher than 2100 K. and a color rendering index Ra of approximately 78. (The symbol "K" as used herein will be understood to refer to "degrees Kelvin".) An advantage of that known lamp therefore is that its light is fairly white. A disadvantage of the known lamp is, however, that its re-ignition voltage is relatively high when the lamp is operated with alternating current.

It should be noted that lamps of the type defined in the preamble are as a rule operated with alternating current, because, when they are operated with direct current the drawback of inter alia metal transport in the discharge tube, also called cataphoresis, would occur.

Re-ignition voltage must here be understood to mean the brief electric voltage required for re-starting the discharge in the discharge tube at the beginning of each half cycle of the electric a.c. power supply. As a rule the re-ignition voltage exceeds the arc voltage of the discharge tube, required in the remaining portion of the half cycle. A relatively large re-ignition voltage must be understood to mean a re-ignition voltage which is much higher than the arc voltage.

A relatively large re-ignition voltage means either that the risk that the lamp will extinguish at a customary drop in the line voltage is great or that a low arc voltage relative to the voltage of the available line voltage must be opted for. A low arc voltage also means a low operating voltage. Operating voltage must here be understood to mean the r.m.s. voltage of the discharge tube.

It is an object of the invention to provide a high-pressure sodium-vapor discharge lamp of the type defined in the preamble which, while retaining the white color of the light, has a low re-ignition voltage.

A high-pressure sodium-vapor discharge lamp according to the invention, comprising a discharge tube which contains an excess of sodium and mercury and also contains xenon, whereby in the operating condition of the lamp the sodium-vapor pressure in the discharge tube exceeds 300 torr and the mercury functions as a buffer gas, is characterized in that the weight of mercury in the discharge tube is between 50% and 90% of the weight of mercury and sodium together in the discharge tube, and the xenon filling pressure at 300 K. is between 100 and 1000 torr; and in that, in the operating condition of the lamp, the sodium-vapor pressure is below 800 torr.

An advantage of this lamp is that the generation of white light is combined with a low re-igniting voltage.

The following should be noted by way of explanation. To obtain a white color of the light at an acceptable luminous efficacy, the color point of the lamp in the C.I.E. (Commission Internationale de l'Eclairage) color triangle must be near the black body curve, namely in the range between approximately 2250 K. and 2750 K. The Y-coordinate of the color point must be between 0.39 and 0.43. This is the range denoted by the hatched parallelogram in the accompanying FIG. 2 of the drawings. With a sodium-vapor pressure in the discharge tube which is in the range of 300 to 800 torr, the color temperature is located in said range from 2250 K. to 2750 K. With a sodium-vapour pressure above 800 torr the luminous efficacy becomes too low.

Increasing the mercury-vapor pressure in the discharge tube results in a reduction of the Y-coordinate of the color point. This means that, by a suitable choice of the mercury-vapor pressure a Y-coordinate in the above defined range can be obtained.

The invention is based on the insight that increasing the pressure of the xenon gas in the discharge tube results in an increase of the Y-coordinate of the color point of the lamp and that it is consequently possible to realize a Y-coordinate between 0.39 and 0.43 by means of various mercury-vapor pressure-xenon pressure combinations. This has resulted in a selection of pressure combinations which furnish lamps with low re-ignition voltages. The selected pressure combinations are combinations wherein the xenon gas in the operating condition of the lamp has a relatively high pressure of approximately 800 to 8000 torr.

The following should be noted as a further explanation of the xenon pressure. The xenon pressure in the operating condition of the lamp is, of course, also determined by the average temperature $T_b$ in degrees Kelvin of the discharge tube of that lamp in the operating condition. If therefore the (cold) filling pressure, at 300 K., of the xenon in the discharge tube is, for example, x torr, the pressure of the xenon in the discharge tube is, for example, $x \cdot (T_b/300)$ torr. For a lamp according to the invention the xenon filling pressure, at 300 K, is between 100 and 1000 torr. With a frequently-occurring $T_b$ of approximately 2400 K. the xenon pressure in the operating condition of the lamp is therefore between approximately 800 and 8000 torr.

The situation can be summarized as follows. A high sodium pressure, of 300 to 800 torr, is required for obtaining the desired color temperature of between 2250 K. and 2750 K. That high sodium-vapor pressure would, by itself, result in a harmfully high re-ignition voltage. However, the choice of a relatively high xenon pressure reduces the re-ignition voltage, the mercury-vapor pressure then being chosen so that the Y-coordinate of the color point is in the required range from 0.39 to 0.43.

The requirements to be imposed on the mercury are satisfied—for the sodium-vapor range defined above—by the formulation of compositions of the amalgam.

With a lamp according to the invention the re-ignition voltage is low, as stated above. This allows the choice of a higher operating voltage V for this discharge lamp, namely about equal to half the rms voltage of the supply mains from which the lamp is to be operated, via a stabilization ballast. With such an operating voltage the influence of mains voltage variations on the brightness of the lamp is—as known already—low.

It should be noted that a high-pressure sodium-vapor discharge lamp comprising a discharge tube which, next to sodium also contains mercury and xenon, wherein the xenon may have a pressure at 300°K. up to 1000 torr, is described in the non-prepublished Dutch Patent Application 7704131. However, the sodium-vapor pressure was then not higher than 200 torr.

The discharge tube of a lamp according to the invention might have a larger inside cross-section and, consequently, a low arc voltage.

As in the discharge tube of a lamp according to the invention the relevant vapor of gas pressure of each of the three constituents of the filling material, namely of the sodium, the mercury and the xenon, is relatively high, the possibility for a large electric gradient is, however, also opened up, that is to say a high value of the ratio between the operating voltage of the discharge tube on the one hand and the spacing between two main electrodes in the discharge tube on the other hand.

In an embodiment of a high-pressure sodium-vapor discharge lamp according to the invention the discharge tube is therefore of a longitudinal shape and is provided with a respective internal electrode at each of itw two ends, and V/A is between 3.5 and 7; where V is the operating voltage, in Volts, of the discharge tube and A is the electrode spacing in mm.

An advantage of this embodiment is that—owing to this large gradient V/A—the discharge tube can be short. Consequently also the lamp can be of a short length.

In an improvement of the above-mentioned embodiment of a lamp according to the invention the discharge tube is of a circle-cylindrical shape and D is between 3 and 6 where D represents the inside diameter, in mm, of the discharge tube.

This improvement has the advantage that the entire discharge tube can be small because now both its length and also its diameter may be of a small dimension. A small discharge tube means that only a small amount of material is required for manufacturing that tube.

In a still further improvement of this embodiment of the lamp according to the invention the electric power of the lamp is 50±5 Watts, the electrode spacing A is 16±3 mm and the inside diameter D of the discharge tube is 3.5±0.3 mm.

An advantage of the lamp according to this further improvement of the embodiment is that it can replace an incandescent lamp of approximately 250 Watts. The lumen value of that lamp, according to the invention, of approximately 50 Watts is approximately equal to the lumen value of an incandescent lamp of approximately 250 Watts. Also this lamp according to the invention furnishes a whitish light and has a high color rendering index Ra, namely approximately 82. The luminous efficacy, for example expressed in lumens per Watt, of the special lamp according to the invention is approximately 5 times as high as that of the comparable incandescent lamp.

It should be noted that the discharge lamp according to the invention—as for substantially any discharge lamp—must as a rule be operated in series with a stabilization ballast.

In a following further embodiment of a lamp according to the invention where V/A is between 3.5 and 7, the lamp is provided with an outer bulb enveloping the discharge tube, whereby the outer bulb is partly provided with a reflector.

An advantage of this lamp is that, owing to the small dimension of the discharge tube, a very good light concentration can be obtained with a lamp having a small volume.

Some embodiments of lamps according to the invention will now be further explained, by way of example, with reference to the accompanying drawings, in which.

Figure 1:
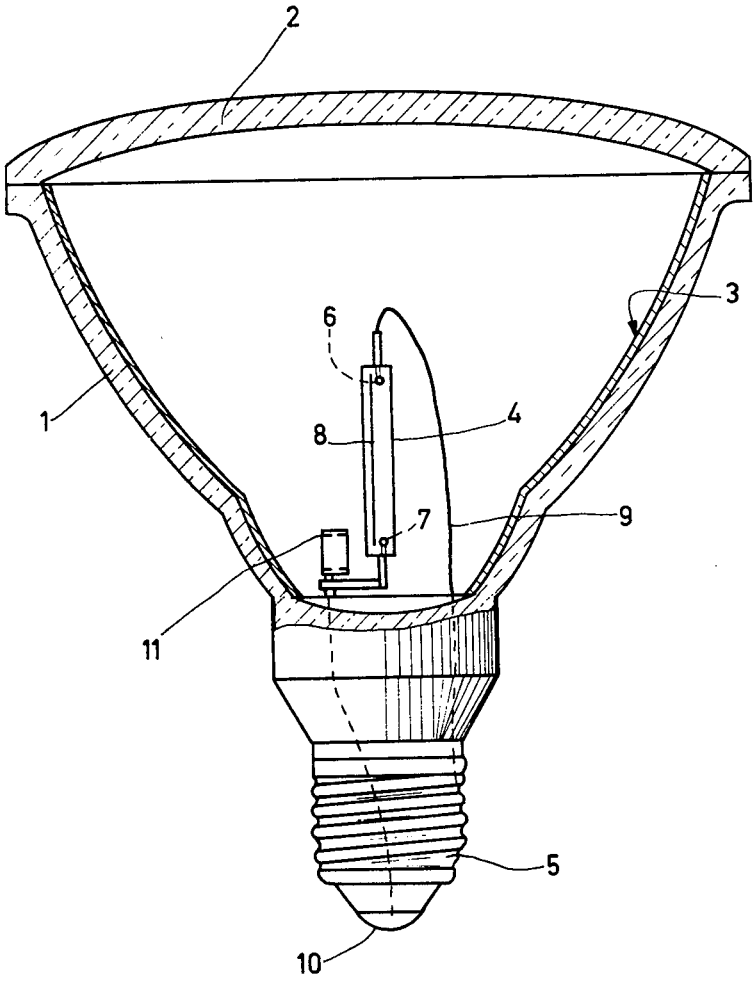
FIG. 1 is an elevational view in partial section of a first high-pressure sodium-vapor discharge lamp according to the invention.

In FIG. 1 reference numeral 1 denotes a rotational-symmetrical pressed glass bulb having a relatively flat light-transmissive portion 2. Reference numberal 3 denotes a reflecting aluminium coating provided on the inner side of the bulb 1. A longitudinal, circle-cylindrical discharge tube 4 whose wall consists of densely-sintered aluminium oxide is disposed within the pressed glass bulb 1. The longitudinal axis of the discharge tube 4 coincides with the symmetrical axis of the bulb 1. Reference numeral 5 denotes a lamp base provided with a screw thread.

The total length of the lamp is approximately 134 mm and its largest diameter is approximately 121 mm. The discharge tube 4 comprises two internal main electrodes 6 and 7 and an external start strip 8. The electrode 6 is connected via a lead 9 to a side contact of the lamp base 5. The electrode 7 is connected to a center contact 10 of the lamp base 5. Numeral 11 denotes a getter ring.

The lamp is connected, in series with an inductive stabilization ballast—not shown—of approximately 0.8 Henry, to an a.c. line voltage of approximately 220 volts, 50 Hertz. This lamp is started by means of a glow starter or an electronic starter not shown in the drawing.

The spacing (A) between the main electrodes 6 and 7 is 16 mm. The inside diameter (D) of the discharge tube 4 is 3.5 mm. Therefore the dimensions of the discharge tube are substantially of the same magnitude as that of a filament of a known incandescent lamp of a similar structure. In addition to xenon gas the tube 4 comprises 10 milligrams of an amalgam which contains sodium and mercury. The weight of mercury therein is 78% of the weight of the mercury and sodium together. Therefore this percentage is between 50% and 90%. Only a part of the sodium and a part of the mercury in the discharge tube are present as vapor in the operating condition of the lamp. Stated another way these metals are present in excess. The temperature of the coldest spot in the discharge tube 4 in the operating condition of the lamp is approximately 1100° K. A sodium vapor pressure of approximately 600 torr corresponds therewith. That is to say the sodium vapor pressure is between 300 and 800 torr.

The xenon filling pressure at 300° K. is 200 torr. The average temperature of the discharge tube 4 in the operating condition of the lamp is approximately 2400° K. The xenon pressure in the discharge tube—in the operating condition—consequently amounts to approximately 1600 torr. The xenon filling pressure of 200 torr is between the pressure limits of 100 and 1000 torr.

The electric power of the lamp described is approximately 50 Watts. Its luminous flux is approximately 3000 lumen. The operating voltage is approximately 100 Volts. In the colour triangle the color point is located at the coordinates x=0.487 and y=0.410. The color temperature is approximately 2400 K. The color rendering index Ra is approximately 82. See also point C in FIG. 2.

The above-mentioned temperature of 1100° K. of the coldest spot in the discharge tube is inter alia realized by means of a small distance between each of the upper ends of the electrodes 6 and 7 and their nearest internal end of the discharge tube 4, for example approximately 4 mm. This so-called top bottom distance of 4 mm can be used here because, owing to the above-mentioned high xenon pressure, the electrodes 4 and 6 can be of a small size. Heat-shields were not required for realizing the temperature of 1100 K.

In the case of the lamp described V/A=100/16=approximately 6.4. Consequently that ratio is between 3.5 and 7.

Furthermore, the inside diameter D=3.5 mm is located in the range between 3 and 6 mm.

The luminous efficacy of the described lamp is approximately 60 lumens per watt. This is approximately five times the luminous efficacy of a 250 Watts incandescent lamp which also furnishes approximately 3000 lumens.

The re-ignition voltage of the described lamp is of such a low value that at a 10% voltage drop of the supply mains no extinguishing of the lamp occurs.

Beaming of the light by the reflector 3 is of such a nature that the luminous intensity in a direction which is at an angle of 8 degrees to the longitudinal axis of the lamp is half the luminous intensity along the longitudinal axis. In the direction of the longitudinal axis the luminous intensity is more than 6000 candelas.

In another embodiment of a lamp according to the invention the axis of the discharge tube might alternatively be arranged transverse to the longitudinal axis of the outer bulb 1.

Figure 2:
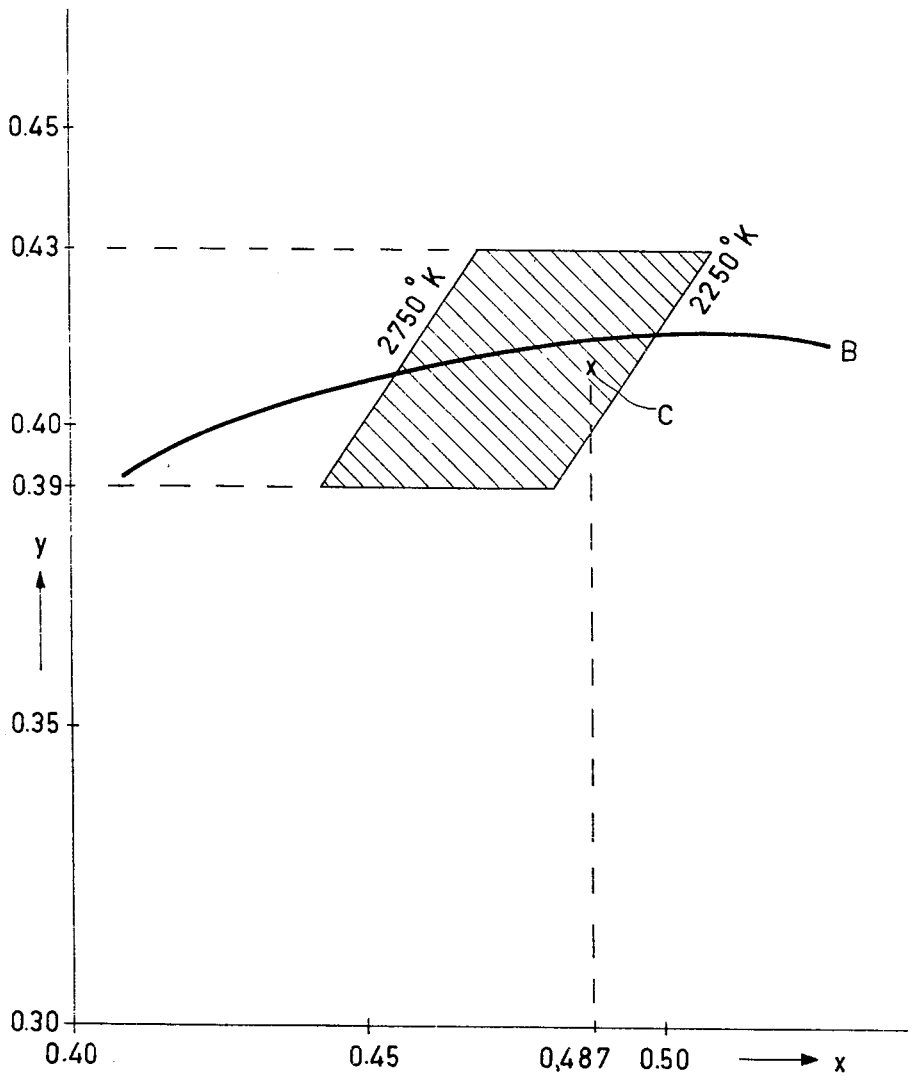
FIG. 2 shows an x-y coordinate system of the color triangle which includes, inter alia, a portion of the black body curve, as well as the color point of the lamp of FIG. 1.

In FIG. 2 the x-y coordinate system of the C.I.E. color triangle shows a portion of the black body curve which is denoted by B. A hatched parallelogram indicates the range of color points between 2250° K. and 2750° K., which also satisfies $0.39<y<0.43$. The point C denoted in FIG. 2 by a cross represents the color point x=0.487; y=0.410 of the lamp of FIG. 1. This color point is located in the preferred range indicated by the parallelogram.

In a further embodiment of the lamp according to the invention the electric power of the lamp is 100 Watts. The inside diameter D of the discharge tube is than 4.8 mm and the electrode spacing A is 30 mm. The operating voltage V is 123 Volts. The weight of the amalgam and its composition is the same as in the lamp of FIG. 1. The sodium-vapor pressure in the operating condition is approximately 550 torr. The xenon pressure is 400 torr at 300° K. An x-coordinate of 0.489 and a y-coordinate of 0.412 were found for this lamp. The Ra is approximately 84 and the luminous efficacy is approximately 61 lumens per watt.

Figure 3:
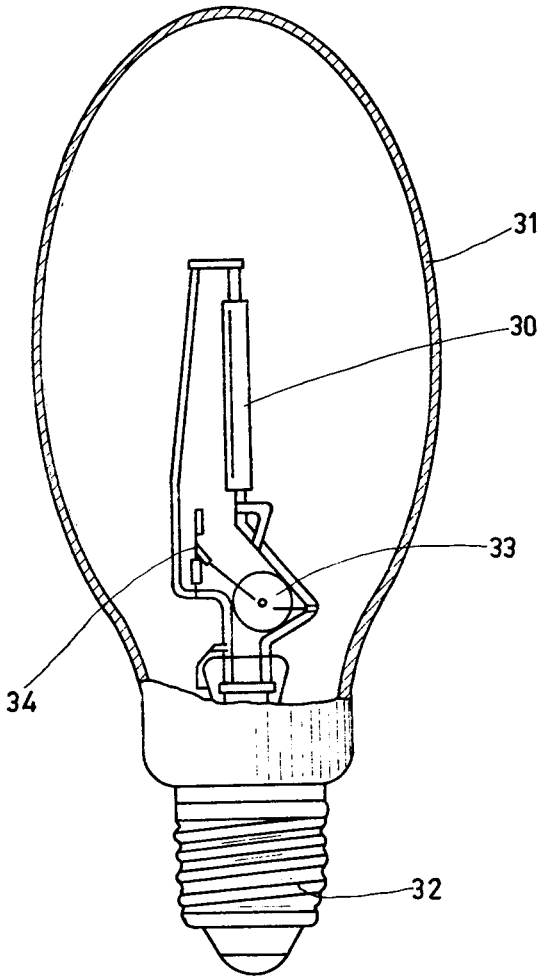
FIG. 3 is an elevational view partial section of a second high-pressure sodium-vapor discharge lamp according to the invention.

FIG. 3 shows a longitudinal cross-section—partly elevational view—of a further high-pressure sodium-vapour discharge lamp according to the invention.

This lamp, of approximately 50 watts, comprises a discharge tube 30 which, as regards its dimensions and filling, is the same as for the tube 4 of the lamp of FIG. 1. An outer bulb 31 has the general form of an ellipsoid. This outer bulb 31 can, if so desired, be coated on the inside with a light-dispersing coating. Reference numeral 32 denotes a lamp base. Reference 33 denotes a glow-starter for starting the lamp and 34 is a bi-metal switch. A series arrangement of the glow-starter 33 and the bi-metal switch 34 shunts the discharge path in tube 30. This lamp is of a type which, not taking the special discharge tube into account, is described in the non-prepublished Dutch Patent Application No. 7704134. The length of the lamp is approximately 152 mm, its largest diameter approximately 70 mm. The luminous flux and the light color of the light emitted by the discharge tube 30 is equal to that of the equally large tube 4 of the lamp shown in FIG. 1.

The described lamps according to the invention can replace incandescent lamps, for example in the case of shopwindow illumination. For the same illuminance level as in the case of the comparable incandescent lamp unit, the electric power of the described lamps according to the invention need only be approximately 20% of the power of incandescent lamps. This means a considerable saving in energy.

Figure 4:
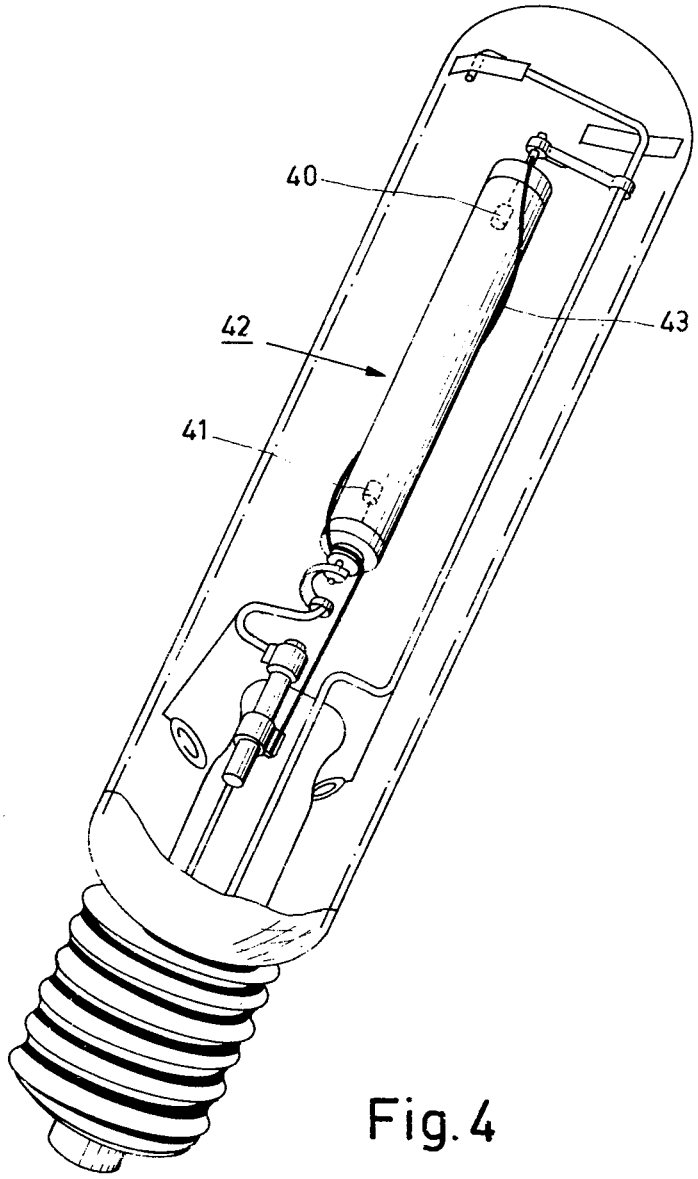
FIG. 4 is a perspective view of another embodiment of a high-pressure sodium-vapor discharge lamp according to the invention.

FIG. 4 shows a further embodiment of a high-pressure sodium-vapor discharge lamp according to the invention, the lamp power being approximately 400 Watt. That lamp is connected, in series with an inductive stabilization ballast of approximately 0.13 Henry (not shown), to an a.c. line voltage of approximately 220 Volts, 50 Hertz. This lamp is started by means of a glow starter or an electronic starter (starters not shown).

The spacing between the main electrodes 40 and 41 of that lamp is 45 mm. The inside diameter of the discharge tube 42 is 11 mm. In addition to xenon gas the discharge tube 42 comprises 20 milligrams of an amalgam which contains sodium and mercury. The weight of mercury therein is 73% of the weight of the mercury and sodium together. Therefore this percentage is between 50% and 90%. Only a part of the sodium and a part of the mercury in the discharge tube 42 are present as vapor in the operating condition of the lamp. Stated another way these metals are present in excess. The temperature of the coldest spot in the discharge tube 42 in the operating condition of the lamp is approximately 1050 K. A sodium vapor pressure of approximately 500 torr corresponds therewith. That is to say the sodium vapor pressure is between 300 and 800 torr.

The xenon filling pressure at 300 K. is 300 torr. The average temperature of the discharge tube in the operating condition of the lamp is approximately 2400 K. The xenon pressure in the discharge tube—in that operating condition—consequently amounts to approximately 2400 torr. The xenon filling pressure of 300 torr is between the pressure limits of 100 and 1000 torr. The discharge tube is provided with an auxiliary electrode 43, around the outside of that tube (42).

The electric power of the lamp described is—see above—approximately 400 Watts. Its luminous flux is approximately 28000 lumens. The operating voltage is approximately 100 Volts. In the color triangle the color point is located at the coordinates x=0.481 and y=0.405. The color temperature is approximately 2400 K. The color rendering index Ra is approximately 86.

The above-mentioned temperature of 1050 K. of the coldest spot in the discharge tube is inter alia realized by means of a small distance between each of the upper ends of the electrodes 41, 42 and their nearest internal end of the discharge tube, namely approximately 6.6 mm. This so-called top bottom distance of 6.6 mm can be used here because, owing to the above-mentioned high xenon pressure, the electrodes can be of a small size. Heat shields were not required for realizing the temperature of 1050 K.

The luminous efficacy of the described lamp is approximately 70 lumens per Watt.

The re-ignition voltage of this lamp is of such a low value that at a 10% voltage drop of the line voltage no extinguishing of the lamp occurs.

What is claimed is:

1. A high-pressure sodium-vapor discharge lamp comprising a discharge tube which contains an excess of sodium, means for buffering comprising mercury and also xenon, the sodium vapor pressure in said discharge tube in the operating condition of the lamp exceeding 300 torr, the weight of mercury in the discharge tube being between 50% and 90% of the weight of mercury and sodium together in the discharge tube, the xenon pressure at 300 K being between 100 and 1000 torr and in the operating condition of the lamp the sodium vapor pressure being below 800 torr.

2. A high-pressure sodium-vapor discharge lamp as claimed in claim 1, the lamp being elongate and being provided with a respective internal electrode at each of its two ends, V/A being between 3,5 and 7 where V is the operating voltage, in Volts of the discharge tube and A represents the electrode spacing in mm.

3. A high-pressure sodium-vapor discharge almp as claimed in claim 2, whereing said discharge tube is circle-cylindrical, D is between 3 and 6 where D represents the inside diameter, in mm, of the discharge tube.

4. A high-pressure sodium-vapor discharge lamp as claimed in claim 3, the electric power consumption of said lamp is approximately 50±5 Watts, the electrode spacing A is 16±3 mm and the inside diameter D of the discharge tube 3.5±0.3 mm.

5. A high-pressure sodium-vapor discharge lamp as claimed in claims 2, 3 or 4, wherein said lamp comprises an outer bulb enveloping the discharge tube, the outer bulb being at least partly provided with a reflector.

* * * * *

UNITED STATES PATENT AND TRADEMARK OFFICE

CERTIFICATE OF CORRECTION

PATENT NO. : 4,253,037

DATED : February 24, 1981

INVENTOR(S) : Antonius J.G.C. Driessen et al

It is certified that error appears in the above-identified patent and that said Letters Patent are hereby corrected as shown below:

Col. 8, Line 5, After "discharge" change "almp" to read --lamp--

Col. 8, Line 6, After "claim 2" change "whereing" to read --wherein--

Signed and Sealed this

*Twentieth* Day of *October 1981*

[SEAL]

*Attest:*

GERALD J. MOSSINGHOFF

*Attesting Officer*

*Commissioner of Patents and Trademarks*